United States Patent [19]

Matthews et al.

[11] 3,992,618

[45] Nov. 16, 1976

[54] GRILL ILLUMINATING MEANS

[76] Inventors: Merritt A. Matthews, 801 Birchwood Drive, Nashville, N.C. 27856; John D. Moore, 1521 Pamela Drive, Monroe, N.C. 28110

[22] Filed: Jan. 2, 1975

[21] Appl. No.: 537,958

[52] U.S. Cl. ..... 240/52 R; 240/47

[51] Int. Cl.[2] ..... F21V 21/00

[58] Field of Search ..... 240/52 R, 47, 52.5, 240/52.1; 313/45

[56] References Cited

UNITED STATES PATENTS

| | | | |
|---|---|---|---|
| 2,524,173 | 10/1950 | Peterson | 240/52.5 X |
| 3,307,026 | 2/1967 | Kramer | 240/52.5 X |
| 3,339,065 | 8/1967 | Keeley | 240/47 X |
| 3,350,554 | 10/1967 | Wood | 240/47 X |
| 3,535,508 | 10/1970 | Warshauser | 240/52 R |
| 3,851,166 | 11/1974 | Kohler | 240/52.1 X |

*Primary Examiner*—R. L. Moses
*Attorney, Agent, or Firm*—Mills and Coats

[57] ABSTRACT

In abstract, a preferred embodiment of this invention is a holder specifically designed for use in connection with grill type cooking devices to support a light adjacent thereto. The light support includes a C-clamp and a heat dissipating portion as well as a multi-position adjustment feature for the light.

7 Claims, 4 Drawing Figures

GRILL ILLUMINATING MEANS

This invention relates to cooking devices and more particularly to improved means for use in supporting a light adjacent grill type and similar cookers.

With the advent of modern "outdoor" cooking popularity, grills of various types have been developed. These include not only charcoal grills but also gas grills and similar units. These cooking units generally are open at the top and, of course, the meat or whatever is being cooked thereon must be periodically inspected for doneness.

Since the evening meal is the one most often cooked on a grill, it often happens that darkness descends before the cooking process is completed. Patio or porch lights are usually turned on at such times but these in many instances prove inadequate for determination of doneness of the food being prepared. Flashlights and similar sources of light have been used but these are extremely unhandy at best since the cooking process quite often requires use of both hands of the cook.

After much research and study into the above mentioned problems, the present invention has been developed to provide a practical, convenient and yet inexpensive lighting means for grill type cookers, particularly of the outdoor variety. This invention includes not only an improved clamping means, but also heat dissipating means to prevent overheating of the illumination portion of the invention.

In view of the above, it is an object of the present invention to provide an illumination means for use in conjunction with grill type cooking means.

Another object of the present invention is to provide an illumination means for use in connection with grill type cooking devices which is readily attachable and detachable from the same.

A further object of the present invention is to provide, in an illuminating device for a grill type cooker, an improved clamp means.

An even further object of the present invention is to provide, in an illumination device for use in conjunction with a grill means, heat dissipation means between the grill connection area and the illumination supporting area.

Another object of the present invention is to provide a simplified and yet highly efficient means for illuminating a grill type cooking device.

Another object of the present invention is to provide a support means for a device for illuminating a grill type cooker wherein the illumination means can be positioned in a plurality of positions and angles.

Other objects and advantages of the present invention will become apparent and obvious from a study of the following description and the accompanying drawings which are merely illustrative of such invention.

IN THE DRAWINGS

Figure 1:
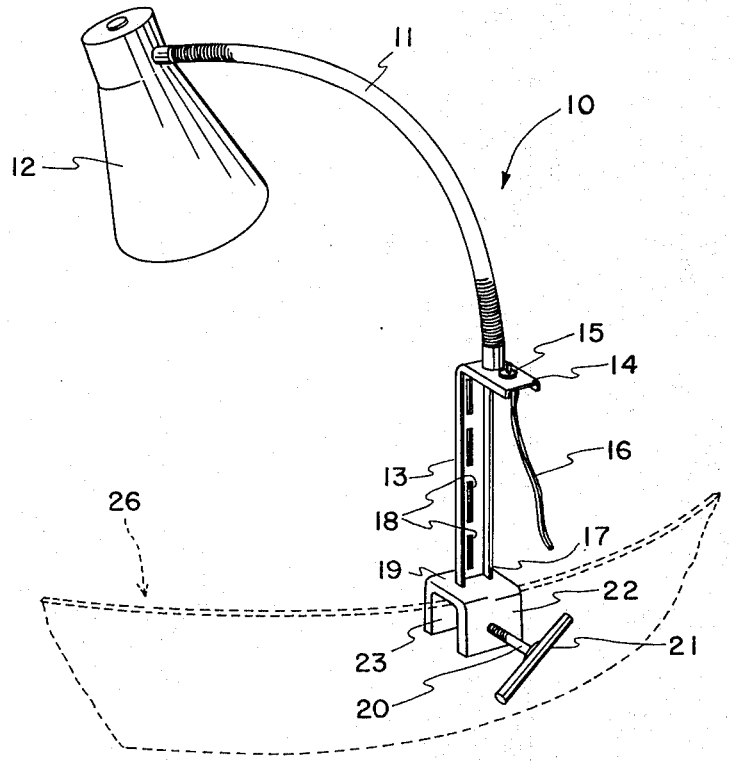
FIG. 1 is a rear perspective view of the improved grill light support means of the present invention.

With further reference to the drawings, the improved grill light support means indicated generally at 10 includes a gooseneck portion 11 with a lamp portion 12 of standard construction and operation operatively mounted on one end thereof.

The end of gooseneck 11 opposite lamp 12 is fixedly secured to the upper part, as oriented in the drawings, of L-shaped heat dissipating portion 13. A standard, commercially available, push button type, electrical switch 15 is fixedly secured to the upper part 14 of heat dissipating portion 13 as is seen clearly in FIGS. 1–3. An electrical conduit or cord 16 extends from a power source (not shown) to switch 15 and on to lamp 12. Since simple electrical systems of this type are well known in the art, a schematic and further description of the same is not deemed necessary.

Between upper area 14 and lower area 17 of heat dissipating portion 13 are provided a plurality of heat dissipating openings 18. Since the lower area 17 of portion 13 will on occasion become hot, the dissipating openings 18 prevent switch 15 and adjacent gooseneck 11 from becoming overheated.

The lower area 17 of dissipating portion 13 is fixedly secured to a U-shaped clamp portion 19. This clamp portion has a threaded opening in one side thereof through which threaded shaft 21 is adapted to threadingly adjustably pass. The end of shaft 20 inside clamp portion 19 is preferably rounded or blunted for the purpose hereinafter described. The end of shaft 20 projecting exteriorly of clamp 19 has fixedly secured thereto T-handle 21.

The side 23 of clamp portion 19 opposite shaft threading side 22 is provided with an opening 24. This opening is preferably of a greater diameter than the diameter of threaded shaft 20. If opening 24 is a one-half inch opening, the diameter of shaft 20 could be approximately two-thirds that distance.

When the clamp portion 19 of the present invention is connected to the side 25 of a grill such as that indicated generally at 26, and threaded shaft 20 is tightened down through the use of handle 21 until such side is gripped between said shaft and side 23, continued tightening of shaft 20 will dimple the side forcing the same up into opening 24 thereby assuring a secure connection which will not slip should the support means be accidentally bumped. This feature of the present invention works particularly well with grills stamped from sheet metal, such types of grills comprising the majority of the outdoor "charcoal" type units sold each year. If a heavy gauge sheet metal or cast iron grill is being used (such as what is commonly referred to as gas grills and Hiabachis), the blunted end portion of threaded shaft 20 can be tightened down to the point of digging into the metal side 25 thus greatly reducing the chances of undesirable slippage due to an accidental blow.

Figure 3:
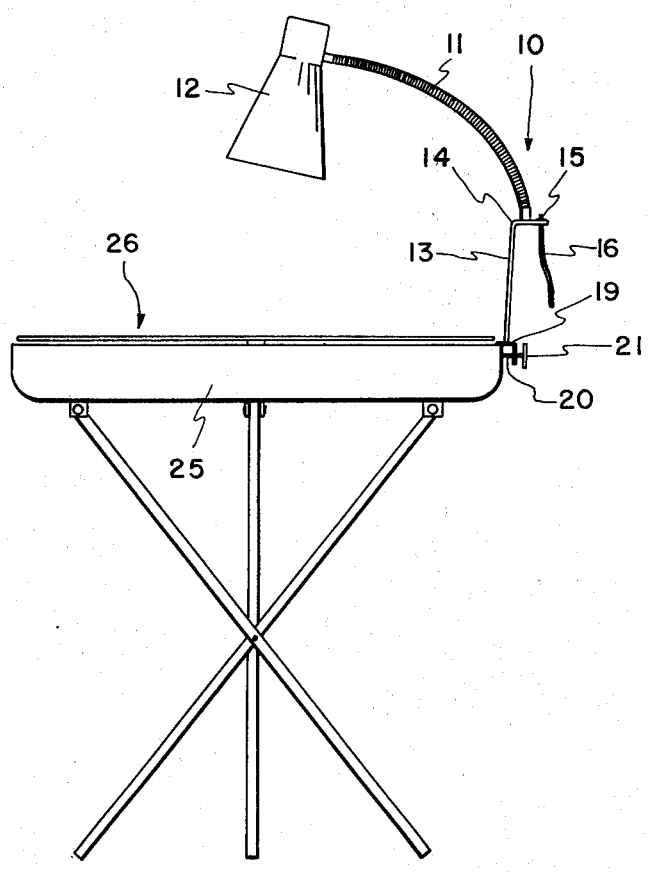
FIG. 3 is a side elevational view of the support means of the present invention operatively mounted on a grill type cooker.
Figure 4:
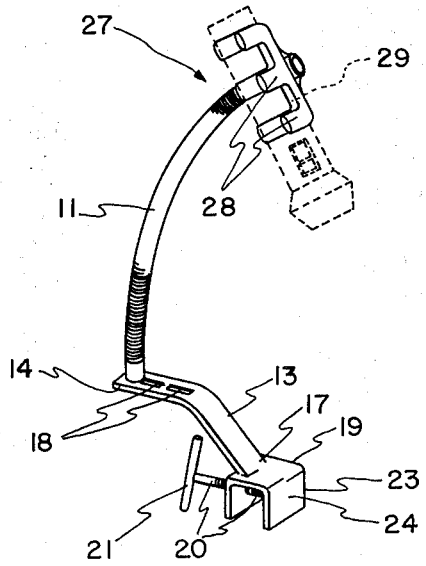
FIG. 4 is a front perspective view of a modification of the present invention.

In the modification disclosed clearly in FIG. 4, a clamping portion 19' is provided with a threaded shaft 20', handle 21' and enlarged opening 24'. To the upper portion of clamp 19' is fixedly secured heat dissipating portion 13' of a slightly different configuration from portion 13 of FIGS. 1–3 but functionally the same with a plurality of heat dissipating openings 18'.

Since heat dissipating portion 13' of the FIG. 4 modification projects upwardly and outwardly from clamp 19', fewer heat dissipating openings 18' are required. A gooseneck 11' is fixedly secured to the upper area 14' of portion 13' but in this modification no switch, such as that indicated at 15, is included. To the end of gooseneck 11' opposite portion 13' is secured a gripping clamp, preferably formed of spring steel. This clamp 27 includes a plurality of fingers 28 which are adapted to engage and hold a portable light source such as the flashlight shown at 29. Thus it can be seen that with the FIG. 4 modification, the present invention can be used in areas where power sources for the type lamp indicated at 12 are unavailable.

Although a standard flashlight 29 is shown in FIG. 4, it is understood that lantern type light sources (not shown) can be readily either grippingly or otherwise supported from the clamp end of gooseneck 11'.

Figure 2:
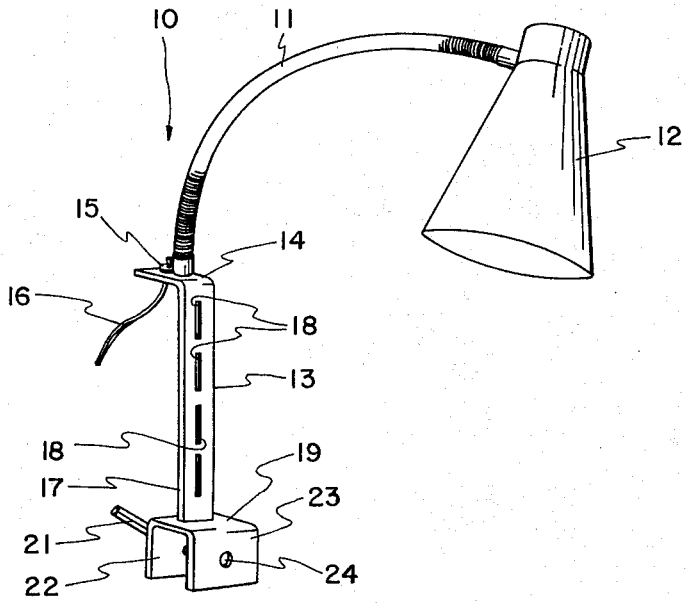
FIG. 2 is a front perspective view of the same.

The clamp 19' of the modification of FIG. 4 operates in the same manner as that described for the clamp portion 19 of the FIGS. 1–3 version of the present invention. Likewise, whatever light source is used with the FIG. 4 modification can be adjusted by movement of gooseneck 11' to any desired location within the limits of travel of such gooseneck.

From the above, it can be seen that the present invention has the advantage of providing a relatively inexpensive and yet highly efficient light system for use in conjunction with cooking type grills. The present invention also has the advantage of allowing the light source supported thereby to be readily beamed either on the grill itself or the adjacent area as need dictates.

The terms "upper," "lower," etc., have been used herein merely for the convenience of the foregoing specification to describe the grill light support means and its parts as oriented in the drawings. It is to be understood, however, that these terms are in no way limiting to the invention since the device may obviously be disposed in many different positions when in use.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended Claims are intended to be embraced therein.

What is claimed is:

1. A heat dissipating light support for use with an outdoor charcoal type grill comprising a light source disposed adjacent said grill; means for securing said light source adjacent one end of a multi-position, adjustable support means; elongated heat dissipating means connected at one end to said support means adjacent its end opposite said light source; and clamp means connected to the end of said heat dissipating means opposite said support means whereby said light source can be operatively and adjustably mounted on said grill for isolating said light source from the heat generated by said grill.

2. The device of claim 1 wherein the multi-position adjustable support means is a flexible gooseneck.

3. The device of claim 1 wherein the heat dissipating means is perforated.

4. The device of claim 1 wherein the clamp means is generally U-shaped in cross section having a shaft threaded through one side and an opening in the opposite side of a larger diameter than said shaft and in axial alignment therewith whereby a dimpled connection can be made between said clamp means and a portion of said grill.

5. The device of claim 1 wherein the light source is energized by household current.

6. The device of claim 1 wherein the light source is energized by current obtained from at least one battery.

7. The device of claim 6 wherein the light source is a flashlight.

* * * * *